US010537928B2

(12) United States Patent
Becker et al.

(10) Patent No.: US 10,537,928 B2
(45) Date of Patent: Jan. 21, 2020

(54) MOLDING TOOL FOR PRODUCING HOT-FORMED COMPONENTS

(71) Applicant: Bayerische Motoren Werke Aktiengesellschaft, Munich (DE)

(72) Inventors: Juergen Becker, Reichertshofen (DE); Bernd Kupetz, Karlsfeld (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/497,769

(22) Filed: Apr. 26, 2017

(65) Prior Publication Data

US 2017/0225214 A1 Aug. 10, 2017

Related U.S. Application Data

(63) Continuation of application No. PCT/EP2015/073207, filed on Oct. 8, 2015.

(30) Foreign Application Priority Data

Oct. 29, 2014 (DE) ..... 10 2014 221 997

(51) Int. Cl.
*B21D 22/02* (2006.01)
*B21D 22/06* (2006.01)
*B21D 37/16* (2006.01)

(52) U.S. Cl.
CPC ..... *B21D 22/022* (2013.01); *B21D 22/06* (2013.01); *B21D 37/16* (2013.01)

(58) Field of Classification Search
CPC ..... B21D 37/16; B21D 22/06; B21D 22/022; B65B 3/022
See application file for complete search history.

(56) References Cited

U.S. PATENT DOCUMENTS 5,916,389 A 6/1999 Lundstroem
2008/0196800 A1 8/2008 Beenken et al.
(Continued)

FOREIGN PATENT DOCUMENTS

CN 1792493 A 6/2006
CN 101189350 A 5/2008
(Continued)

OTHER PUBLICATIONS

Machine translation of JP 2007-075834 A, Ishimori et al., pp. 1-13, translated on Mar. 22, 2018.*
(Continued)

*Primary Examiner* — Teresa M Ekiert
(74) *Attorney, Agent, or Firm* — Crowell & Moring LLP

(57) ABSTRACT

A molding tool is provided for producing hot-formed components, in particular formed sheet metal parts. The molding tool includes a tool lower part and a tool upper part which are movable in relation to each other, and which include corresponding operative faces for shaping a hot-formed component. The operative face of at least one of the tool parts is configured so as to be coolable and that tool part includes cooling lines therein. At least one of the tool parts includes a clearance which in a closed state of the molding tool, conjointly with the hot-formed component, forms an air chamber. The air chamber functions as a thermal insulator between the hot-formed component and the tool part.

10 Claims, 1 Drawing Sheet

(56) References Cited

U.S. PATENT DOCUMENTS

| | | | | |
|---|---|---|---|---|
| 2013/0025340 | A1 | 1/2013 | Kobayashi | |
| 2013/0243548 | A1* | 9/2013 | Yamamoto | B21D 5/16 413/1 |
| 2015/0144232 | A1 | 5/2015 | Loecker | |
| 2015/0246383 | A1* | 9/2015 | Young | B21D 37/16 72/342.3 |

FOREIGN PATENT DOCUMENTS

| | | | |
|---|---|---|---|
| CN | 101288889 | A | 10/2008 |
| CN | 201231286 | Y | 5/2009 |
| DE | 197 23 655 | B4 | 5/2007 |
| DE | 10 2009 020 423 | A1 | 11/2010 |
| DE | 10 2014 108 901 | B3 | 10/2015 |
| JP | 2007-75834 | A | 3/2007 |
| KR | 10-2013-0108899 | A | 10/2013 |
| WO | WO 2009/123538 | A1 | 10/2009 |
| WO | WO 2014/012831 | A1 | 1/2014 |
| WO | WO 2015/197469 | A1 | 12/2015 |

OTHER PUBLICATIONS

International Search Report (PCT/ISA/210) issued in PCT Application No. PCT/EP2015/073207 dated Feb. 12, 2016 with English-language translation (six (6) pages).

German-language Written Opinion (PCT/ISA/237) issued in PCT Application No. PCT/EP2015/073207 dated Feb. 12, 2016 (five (5) pages).

German Search Report issued in counterpart German Application No. 10 2014 221 997.3 dated Jun. 17, 2015 with partial English-language translation (eleven (11) pages).

Chinese-language Office Action issued in counterpart Chinese Application No. 201580039777.1 dated Feb. 2, 2018 with English translation (Seventeen (17) pages).

* cited by examiner

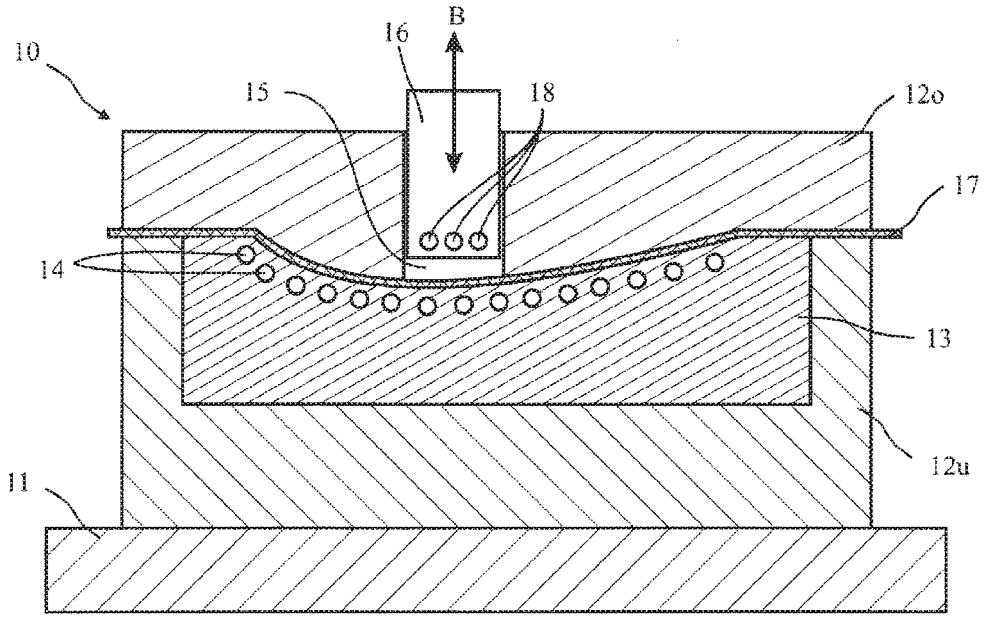
10
16
B
15
18
12o
17
14
13
12u
11

MOLDING TOOL FOR PRODUCING HOT-FORMED COMPONENTS

CROSS REFERENCE TO RELATED APPLICATIONS

This application is a continuation of PCT International Application No. PCT/EP2015/073207, filed Oct. 8, 2015, which claims priority under 35 U.S.C. § 119 from German Patent Application No. 10 2014 221 997.3, filed Oct. 29, 2014, the entire disclosures of which are herein expressly incorporated by reference.

BACKGROUND AND SUMMARY OF THE INVENTION

The invention relates to a molding tool for producing hot-formed components.

In present-day automotive engineering, vehicle passenger comfort is increasingly improved by employing optional equipment. The latter includes many electromechanical components such as sensors, motors, actuators, and serves to facilitate the driving task for the driver. However, as comfort increases, so does the vehicle weight. In order to counteract the latter, attempts at designing the structural components of the bodywork in a weight-reduced manner are made in the prior art.

The structural components of the bodywork are not only relevant to the stability of the vehicle, but also play a decisive role in terms of crash safety. In order for this conflict of aims between reducing the component weight of structural components and at the same time maintaining or implementing, respectively, high mechanical characteristics to be resolved, it has proven successful in the past for structural parts to be produced by hot-forming. Hot-forming processes are also referred to in the literature as form-hardening or press-hardening.

Two fundamentally dissimilar methods are known for producing form-hardened components, in particular for producing bodywork components. In the case of the direct hot-forming method, a blank is initially heated in a furnace to a temperature above the austenitizing temperature of the steel, and is subsequently simultaneously formed and cooled, that is to say form-hardened, in a tool. In the indirect hot-forming method, a fully formed and trimmed component from steel is first generated from a blank by cold-forming. The component is then heated in a heating plant to a temperature above the austenitizing temperature of the steel, and is subsequently form-hardened by rapid cooling in a tool. In both hot-forming methods, the blank or an already fully formed and trimmed component from steel, subsequent to heating to the austenitizing temperature, is thermomechanically formed in the tool, wherein thermomechanical forming is performed at a temperature above the Ac3 austenitizing temperature (approx. 830° C.), preferably between 900 and 1100° C. Cooling of the formed workpieces is performed by means of a cooling unit which is located in a closed tool body. For this reason, components having particularly advanced mechanical properties, in particular having high strengths, may be generated.

Patent document DE 19723655 B4 describes a method for producing sheet-steel panel products by heating a cut-to-measure steel-sheet panel, hot-forming the steel-sheet panel in a pair of tools, hardening the product formed by rapid cooling from an austenitizing temperature while the panel continues to be held in the pair of tools, and subsequent processing of the product.

Proceeding from this prior art, it is an object of the present invention to provide a molding tool for producing components, in particular vehicle components made of sheet metal, in which particularly good mechanical characteristics are accomplished and the component weight is reduced at the same time.

This and other objects are achieved in accordance with embodiments of the invention.

In order for this object to be achieved, the invention proposes a molding tool for producing hot-formed components, in particular formed sheet metal parts, having a tool lower part and a tool upper part which are movable in relation to one another, and which are configured with communicating operative faces for shaping the component. At least the operative face of a tool part is at least in portions configured so as to be coolable and cooling lines are provided in the tool part. At least one clearance which in a closed state of the tool conjointly with the component forms an air chamber which functions as a thermal insulator between the component and the tool part may be provided in at least one of the two tool parts. The subject matter of the invention is based on the effect of a workpiece that has been heated in a furnace to a temperature above Ac3, is moved in between the tool parts and is hot-formed by the direct method, while the workpiece simultaneously is geometrically formed and thermally cooled. In that region of the workpiece to which the clearance is adjacent, a medium that is trapped in the chamber serves as an insulator such that on the workpiece in the region of the chamber is cooled more slowly than in the remaining regions of the component. For this reason, a microstructure having lower mechanical strength is established in this region of the workpiece than in the remaining component. Gases, for example inert gases or ambient air, are particularly suitable as media.

The clearance may be configured so as to be variable in volume. For this reason, the amount of air in the chamber may be increased or decreased as required, and thus the level of insulation in relation to the cooled workpiece may be varied. Accordingly, better insulation is achieved as the greater the amount of air is present in the chamber.

An insert that configures a tool-side rear wall of the air chamber may be disposed in the tool part in which the clearance is configured. In other words, the insert has a surface portion that faces the component and that forms part of the wall of the clearance.

Furthermore, the insert may is disposed in the tool part so as to be movable, in particular displaceable in a linear manner. For this reason, depending on the desired degree of insulation, the insert may be transferred to a corresponding position, and the volume of the air chamber may be defined accordingly.

Moreover, ducts may be provided in the insert for controlling the temperature of the insert. The insert is preferably set to a predetermined temperature by way of a temperature-controlled medium, in particular by way of a gas or a liquid, for example oil or water. The medium herein is temperature-controlled in a heating and/or cooling installation and is directed through the ducts of the insert. This offers the advantage that the insert, as required, may be heated or cooled. For this reason, the volume in the chamber may likewise be temperature-controlled, thereby desired mechanical properties may be set in specific regions of the sheet metal part.

The insert in a closed state of the tool may be in a retracted position in order for the clearance to be generated. In this position, a chamber that is filled with a medium/air is then configured. The insert in an opened state of the tool may be in an advanced position in which the volume of the clearance is at least reduced in relation to the volume of the clearance in the retracted position of the insert. For this reason, the air is removed from the chamber, selectively after each forming procedure or after a predefined number of forming procedures, thereby the air in the chamber is prevented from being excessively heated. The clearance, or the chamber, respectively, is consequently regularly purged with the medium/air. The hot-forming procedure, and not least the microstructure in this region of the workpiece, is thus not compromised.

In an alternative embodiment, the clearance may be actively purged by way of a control unit or a regulating unit.

The formed sheet metal parts may be configured from a ferrous metal, in particular from steel, and/or from a non-ferrous metal, in particular from aluminum and/or magnesium.

The cooling lines may carry a coolant in a manner that is substantially parallel with a surface of the component. The coolant, which may be gaseous or liquid, is conducted in the cooling lines and does not come into direct contact with the component. The thermal energy of the coolant in the cooling lines acts through the material of the tool part on the component or the workpiece, and physically contacts the tool part during forming. Thus, individual regions of the component or of the workpiece may be cooled at variable speed or at variable intensity, and various mechanical properties may be implemented in the component for this reason.

Moreover, the cooling lines may be supplied with coolant by way of a common infeed system. This offers the advantage that a uniform temperature control or a supply of coolant of identical temperature is ensured in all cooling lines.

In a further alternative embodiment of the molding tool, the operative face of the tool upper part, and/or the operative face of the tool lower part may at least in portions be configured so as to be coolable. By virtue of the minor thickness of the sheet metal component that is in the range of 0.5 to 5 mm, unilateral cooling is sufficient. However, in order for particularly rapid and intense cooling to be implemented, it may be advantageous for bilateral cooling to be implemented.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 is a sectional view through a molding tool.

DETAILED DESCRIPTION OF THE DRAWING

FIG. 1 shows a molding tool 10 that is employable in presses for hot-forming tools, in particular sheet metal blanks, to form sheet metal components 17. The molding tool 10 has a lower tool half 12*u* which bears on a base plate 11. The lower tool half 12*u* interacts with an upper tool half 12*o*. The mutually facing operative faces of the upper tool half 12*o* and the lower tool half 12*u* are configured so as to be mutually corresponding such that they act like a die and a punch of a press tool. In the example illustrated in FIG. 1, the upper tool half 12*o* is configured as the punch, and the lower tool half 12*u* is configured as the die. Without departing from the scope of the invention, in alternative embodiments (not shown), the upper and the lower molding-tool halves may be reversed in terms of their arrangement, such that the upper tool functions as a die, and the lower tool functions as a punch. The upper tool half 12*o* and the lower tool half 12*u* are movable in relation to one another. The molding-tool halves 12*o*, 12*u*, as illustrated in FIG. 1, can be moved apart and moved back together. During moving together of the molding-tool halves, a sheet metal piece or a sheet metal blank is caught between the molding-tool halves, and is encompassed and formed by the operative faces of the molding-tool halves 12*o*, 12*u*. The state illustrated in FIG. 1 corresponds to a terminal position of the tool halves 12*u*, 12*o* in the case of a forming procedure in which the sheet metal component 17 is fully formed.

An insert 16 which is movable along the double arrow B in relation to the upper tool half 12*o* is shown in the upper tool half 12*o*. The insert 16 is thus displaceable in a linear manner in the direction toward the component 17, and away from the component 17. The insert 16 in FIG. 1 carries out a linear movement that is substantially perpendicular to the component surface. Alternatively thereto, a movement that is oblique to the component surface may also be carried out, however. In the closed state of the tool 10, as illustrated in FIG. 1, the insert 16 forms a clearance 15. The clearance 15 functions as a chamber which is filled with air. This chamber 15 is encompassed by a surface of the insert 16 that faces the component 17, by an internal surface of the breakout through the upper tool half 12*o*, the insert 16 being incorporated therein, and by a portion of the surface of the component 17. The air in this chamber 15 insulates the warm sheet metal part 17 emerging from the furnace in relation to the upper tool half 12*o* and the insert 16 that is located in the latter. Thus, the heat transfer from the component 17 to the molding tool 10 at this location is slower than in the remaining component regions in which the component 17 is in direct physical contact with the tool 10. The component 17 in the region of the air chamber 15 cools more slowly, such that a microstructure having low mechanical characteristics, in particular having low strength values, is established in this region. The air gap 15 thus covers exactly that region that in the later component, or vehicle, respectively, is characterized by low strength and thus high ductility. The properties of the component may thus be set such that targeted deformation of the ductile region results in the case of a vehicle crash.

The size of the air chamber 15 may be varied by displacing the insert 16. Depending on the chosen position of the insert 16, that is to say depending on the size of the air chamber 15, correspondingly different desired strength values may be set in the region of the component. The air chamber 15 herein, having in particular a small volume, may also be configured as a gap.

As an alternative to the medium of air, other gases may also be used for filling the chamber 15.

According to one embodiment of the invention, ducts 18 which serve for controlling the temperature of the insert may optionally be disposed in the insert 16.

To this end, the insert 16 is purged with a temperature-controlled medium, and is set to a predetermined temperature. The medium herein is pre-temperature-controlled in a heating and/or cooling installation, and is directed through the ducts 16 of the insert 18. The temperature of the insert 16 and thus of the air in the chamber 15 may thus be controlled or regulated by way of the temperature of the medium. Gases, for example inert gases, or liquids, for example oil or water, are particularly suitable as media. However, the provision of ducts 18 is only optional. In other embodiments of the invention, the insert 16 may also be configured without the medium-carrying ducts 18.

A mold insert 13 in which a cooling system that has a plurality of cooling lines 14 is integrated is provided in the lower molding-tool half 12*u*. On the one hand, the use of molding insert 13 of this type offers the advantage that dissimilar component contours may be embossed using one lower molding tool 12*u*, in that the mold insert 13 may be replaced so as to correspond to the desired component shape. The cooling lines 14 are in fluidic communication with a distributor or connector system. The coolant is thus introduced by way of the connector system and distributed to the cooling lines 14.

The cooling lines 14 illustrated in FIG. 1 run in a manner substantially parallel with the surface of the component 17, and thus also substantially parallel with the operative face of the molding-tool halves 12*u*, 12*o*. The cooling lines 14 thus follow the component contour at a specific spacing therefrom into the mold insert 13 of the lower molding-tool half 12*u*.

Gaseous cooling media, liquid cooling media, or a combination thereof are suitable as coolants for the cooling lines 14.

Only a single insert 16 which is disposed in the upper tool part 12*o* is depicted in FIG. 1. In the case of a further embodiment of the invention (not illustrated), the insert may be disposed in the lower tool part 12*u*. Alternatively, one or a plurality of inserts 16 may be positioned both in the upper as well as in the lower tool half 12*o*, 12*u*. Moreover, only the lower tool half 12*u* is provided with cooling lines 14 in the exemplary embodiment shown in FIG. 1. Alternatively thereto, the arrangement of the cooling system, that is to say the connector system and the cooling lines 14, in further embodiments of the invention, may also be disposed in the upper tool half 12*o*. In one further alternative embodiment, cooling lines 14 may be provided both in the upper tool half 12*o* as well as in the lower tool half 12*u*. Moreover, a mold insert 13 may alternatively be disposed in the upper tool half 12*o*, or in both tool halves.

LIST OF REFERENCE SIGNS

10 Molding tool
11 Tool base plate
12*u* Tool lower part
12*o* Tool upper part
13 Tool insert
14 Cooling lines
15 Clearance
16 Insert
17 Component
18 Ducts The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A molding tool for producing a hot-formed component, comprising:

a tool lower part and a tool upper part which are movable in relation to each other, and which include corresponding operative faces for shaping the component, where the operative face of at least one of the tool lower and upper parts is at least in part configured so as to be coolable and the at least one of the tool lower and upper parts includes cooling lines therein, wherein at least one of the tool lower and upper parts includes at least one clearance which in a closed state of the molding tool, conjointly with the component, forms an air chamber which functions as a thermal insulator between the component and the at least one of the tool lower and upper parts which includes the at least one clearance defined on at least one side by the component, the at least one of the tool lower and upper parts which includes the at least one clearance has an insert in the at least one clearance that forms a tool-side rear wall of the air chamber, the at least one clearance is configured so as to be variable in volume, and the molding tool is configured such that in an opened state of the molding tool the insert is in an advanced position in which the insert is closer to the operative faces of the tool upper and lower parts than when the insert is in a retracted position away from the operative faces.

2. The molding tool according to claim 1, wherein the insert is movably disposed in the at least one of the tool lower and upper parts which includes the at least one clearance.

3. The molding tool according to claim 2, wherein the insert is displaceable in a linear manner.

4. The molding tool according to claim 3, wherein when the molding tool is in a closed state the insert is in a retracted position in order for the at least one clearance to be generated.

5. The molding tool according to claim 2, wherein when the molding tool is in a closed state the insert is in a retracted position in order for the at least one clearance to be generated.

6. The molding tool according to claim 1, wherein the insert includes ducts therein.

7. The molding tool according to claim 1, wherein the hot-formed component is a formed sheet metal part configured from either a ferrous metal or a non-ferrous metal.

8. The molding tool according to claim 7, wherein the formed sheet metal part is configured at least in part from one of steel, aluminum and magnesium.

9. The molding tool according to claim 1, wherein the insert is configured from metal, non-metal, or a combination thereof.

10. The molding tool according to claim 9, wherein the non-metal includes concrete and wood.

* * * * *